US006068957A

United States Patent [19]

Nair et al.

[11] Patent Number: 6,068,957

[45] Date of Patent: May 30, 2000

[54] LUBRICATING LAYER IN PHOTOGRAPHIC ELEMENTS

[75] Inventors: Mridula Nair, Penfield; Tamara K. Osburn; Louis J. Sorriero, both of Rochester, all of N.Y.

[73] Assignee: Eastman Kodak Company, Rochester, N.Y.

[21] Appl. No.: 09/107,200

[22] Filed: Jun. 29, 1998

[51] Int. Cl.[7] ..... G03C 1/76; G03C 8/52; G03G 5/147

[52] U.S. Cl. ..... 430/66; 430/201; 430/531; 430/523; 430/536; 430/537; 430/961; 347/105; 503/227

[58] Field of Search ..... 430/537, 631, 430/961, 531, 536, 66, 523, 201; 347/105; 503/227

[56] References Cited

U.S. PATENT DOCUMENTS

| | | | |
|---|---|---|---|
| 4,833,060 | 5/1989 | Nair et al. | 430/137 |
| 5,529,891 | 6/1996 | Wang et al. | 430/523 |
| 5,541,048 | 7/1996 | Whitesides et al. | 430/523 |

*Primary Examiner*—Richard L. Schilling
*Attorney, Agent, or Firm*—Carl F. Ruoff

[57] ABSTRACT

The present invention is an imaging element which includes a support, at least one imaging layer superposed on the support and a protective topcoat superposed farthest from the support. The topcoat includes a binder and lubricant droplets. The lubricant droplets are composed of a lubricant and a water soluble polymer containing heterocyclic aromatic nitrogen groups wherein the droplets are surrounded by a particulate stabilizer. The present invention is also directed to the lubricant droplets.

15 Claims, No Drawings

LUBRICATING LAYER IN PHOTOGRAPHIC ELEMENTS

FIELD OF THE INVENTION

This invention relates in general to imaging and in particular to a novel imaging element that is especially useful in photographic film and paper. More specifically, this invention relates to a photographic element having at least one light-sensitive layer and a protective topcoat, the topcoat being farthest from the support and containing lubricant droplets and a water soluble polymer containing heterocyclic aromatic nitrogen groups.

BACKGROUND OF THE INVENTION

Various lubricants have been employed in photographic film and papers products, especially in the outermost layer or layers of the element.

In U.S. Pat. No. 5,529,891, droplets of lubricant having a size relationship with respect to the thickness of the layer of a photographic element in which the droplets reside are disclosed. It is desired that the lubricating droplets have a narrow particle size distribution.

Because of the nature of liquid lubricant droplets, it is extremely difficult to obtain droplets that are stable over any length of time. Thus, it is readily apparent that it is difficult to provide uniformly sized, stable lubricant droplets. U.S. Pat. No. 5,541,048 describes a process for making stable lubricant droplets capable of being applied from a coating composition to form layers of uniformly sized lubricant droplets in a binder and photographic elements having at least one layer containing uniformly sized and dispersed lubricant droplets. Combining these lubricant droplets with a hydrophilic binder such as gelatin is not straightforward and requires a surfactant to prevent destabilization or aggregation of the lubricant droplets. Additionally, in making the lubricant droplets, a solvent, either volatile or permanent is necessary in order to increase the surface energy of the droplet and facilitate the partitioning of the particulate suspension stabilizing agent onto the surface of the lubricant droplets from the water medium.

It is toward the objective of overcoming the aforesaid problems and limitation of the prior art that the present invention is directed.

SUMMARY OF THE INVENTION

The present invention is an imaging element which includes a support, at least one imaging layer superposed on the support and a protective topcoat superposed farthest from the support. The topcoat includes a binder and lubricant droplets. The lubricant droplets are composed of a lubricant and a water soluble polymer containing heterocyclic aromatic nitrogen groups wherein the droplets are surrounded by a particulate stabilizer. The present invention is also directed to the lubricant droplets.

DETAILED DESCRIPTION OF THE INVENTION

The imaging elements of this invention can be of many different types depending on the particular use for which they are intended. Such elements include, for example, photographic, electrophotographic, electrostatographic, photothermographic, migration, electrothermographic, inkjet receiving paper, dielectric recording and thermal-dye-transfer imaging elements. Photographic elements can comprise various polymeric films, papers, glass, and the like.

The thickness of the support is not critical. Support thickness of 2 to 15 mils (0.05 to 0.40 millimeters) can be used. The supports typically employ an undercoat or subbing layer well known in the art or are treated with a corona discharge to improve adhesion.

In accordance with this invention a novel imaging element that is especially useful in photographic film and paper includes a photographic element having at least one light-sensitive layer and a protective topcoat, the topcoat being farthest from the support and containing lubricant droplets and a water soluble polymer containing heterocyclic aromatic nitrogen groups.

The water soluble polymer containing heterocyclic aromatic nitrogen groups is very effective in enhancing the adsorption of the particulate suspension stabilizing agent at the interface between the low surface energy lubricant droplet and water. This polymer aids in keeping the particles well dispersed in water thereby prolonging the shelf life of an aqueous colloidal dispersion of the oil droplets. Additionally, the water soluble pyridine containing polymer enhances the dispersibility of the droplets in hydrophilic colloids such as gelatin without the need for an added surfactant.

In a preferred embodiment of the present invention, the lubricant layer utilizes silicone oil droplets particularly DC200 (polydimethyl siloxane) made by Dow Corning as the lubricant. The preparation of such size stable lubricant droplets involves forming a discontinuous phase of lubricant droplets in a continuous aqueous phase containing a particulate suspension stabilizing agent. The lubricant droplets are reduced in size and prevented from coalescing by action of the particulate suspension stabilizing agent as described in U.S. Pat. No. 5,541048. In the preparation of photographic elements containing a layer having therein lubricant droplets, it has been found that the size of the lubricant droplets and the uniformity of the droplets size is an important parameter with regard to the quality of the photographic image, and the scratch resistance of the photographic element when it comes in contact with other parts of the apparatus in which it is employed, such as, cameras, photo processes apparatus, and the like. A particular embodiment of this is set forth in previously mentioned U.S. Pat. No. 5,529,891.

The lubricant droplets as described herein are prepared by forming a discontinuous phase of lubricant droplets in a continuous aqueous phase containing a particulate suspension stabilizing agent, reducing the size of the lubricant droplets and limiting the coalescence of the droplets by the action of the particulate suspension stabilizing agent on the surface of the droplets.

In one embodiment the particular lubricant employed is mixed with either a volatile solvent or with a permanent solvent and then dispersed in an aqueous medium containing the particulate suspension stabilizing agent and the promoter, the purpose of which is to drive the particulate suspension stabilizing agent to the interface between the lubricant droplet and the water medium. The dispersion of lubricant droplets in the aqueous medium is then vigorously mixed by any suitable device including high speed agitation, ultrasonic devices, homogenizers, and the like in order to reduce the particle size of the lubricant droplets to less than that ultimately desired. The presence of the particulate suspension stabilizer then controls the level of coalescence that takes place until an equilibrium is reached and the particle size does not grow any farther. The primary role of the solvents is to lower the viscosity of the oil phase if necessary and sometimes to enhance the surface energy of the oil droplets and promote adsorption of the particulate stabilizer at the interface. In another embodiment where no solvent is used, the viscosity of the oil phase is lowered by raising the temperature of the system. Any of these methods give narrow particle size distributions with the mean particle size of the droplets being controlled by the amount of the particulate suspension stabilizing agent employed in the preparation of the dispersion. In the preparation including the volatile solvent, the solvent can then be driven off by raising the temperature to above the volatilization temperature of the solvent. The droplets are further employed in the preparation of a coating composition for use in the preparation of an imaging element. In the case using a permanent solvent and where no solvent is used, the droplets including the permanent solvent are employed directly in the preparation of the coating composition.

In order to provide suitable formulations for applying a layer containing the lubricant droplets in accordance with this invention for use in a photographic element, the dispersions prepared by the methods described above, are combined with a hydrophilic colloid, gelatin being the preferred material.

There is no limitation on the types of lubricants for the practice of the present invention as long as they are liquid or can be dissolved or suspended in an appropriate liquid phase. Typical lubricants include (1) silicone based materials disclosed, for example, in U.S. Pat. Nos. 3,489,567, 3,080,317, 3,042,522, 4,004,927, 4,047,958, and in British Patent Nos. 955,061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc., disclosed in U.S. Pat. Nos. 2,454,043, 2,732,305, 2,976,148, 3,206,311, 3,933,516, 2,588,765, 3,121,060, 3,502,473, 3,042,222 and 4,427,964, in British Patent Nos. 1,263,722, 1,198,387, 1,430,997, 1,466,304, 1,320,757, 1,320,565, and 1,320,756, and in German Patent Nos. 1,284,295 and 1,284,294; (3) liquid paraffin and paraffin or wax like materials such as carnauba wax, natural and synthetic waxes, petroleum waxes, mineral waxes and the like; (4) perfluoro- or fluoro- or fluorochloro-containing materials, which include poly(tetrafluoroethylene), poly(trifluorochloroethylene), poly(vinylidene fluoride, poly(trifluorochloroethylene-co-vinyl chloride), poly(meth)acrylates or poly(meth) acrylamides containing perfluoroalkyl side groups, and the like. Lubricants useful in the present invention are also described in further detail in *Research Disclosure* No. 308, December 1989, page 1006, all of the above incorporated herein by reference.

The above lubricants also may contain reactive functional groups such as hydroxyl, thiol, carboxyl, carbodiimide, epoxy, aziridine, vinyl sulfone, sulfinic acid, active methylene, amino, and amide. Typical examples of compounds useful for the present invention are shown below, but the present invention is not limited by these compounds:

Carnauba Wax, Michelube 160 [Michelman Inc.]
Paraffin Wax 112/118 AMP, m.p.=46.1° C. [Frank B. Ross Inc.]
Paraffin Wax 125/130 AMP, m.p.=53.3° C. [Frank B. Ross Inc.]
Paraffin Wax 140/145 AMP, m.p.=61.1° C. [Frank B. Ross Inc.]
Ross Wax 140, m.p.=137.8° C. [Frank B. Ross Inc.]
GP-218 silicone polyol copolymer [Genesee Polymers Co.]
GP-4 silicone fluid, amine functionalized [Genesee Polymers Co.]
GP-7100 amine functional paintable silicone fluid [Genesee Polymers Co.]
GP-7200 silicone fluid, mercapto functionalized [Genesee Polymers Co.]
EXP-58 silicone wax [Genesee Polymers Co.]
EXP-61 silicone wax, amine functionalized [Genese Polymers Co.]
EXP-77 silicone wax, mercapto functionalized [Genesee Polymers Co.]
GP-7101 silicone copolymer [Genesee Polymers Co.]
BYK-331, polyether modified di-methylpolysiloxane copolymer [BYK Chemie]
BYK-371, reactive silicone additive, an acrylic functional, polyester-modified dimethylpolysiloxane [BYK Chemie]
DC-200 silicone fluid [Dow Corning Inc.]
PS099 dimethylsiloxane-bisphenol A carbonate block copolymer [Petrarch Inc.]
PS 130 polymethyloctadecylsiloxane [Petrarch Inc.]
PS 135 poly(methylhexadecyl siloxane) [Petrarch Inc.]
PS-464 polydimethylsiloxane, vinylphenylmethyl terminated [Petrarch Inc.]
Ethylene glycol distearate
Ethylene glycol monostearate
Lubracal 60, Calcium stearate
Glyceryl monostearate Silicone oils are the preferred lubricant for practicing this invention. Polydimethyl siloxane, particularly DC200 made by Dow Corning, is most preferred.

As for the suspension stabilizing agents that surround the lubricating properties and which serve in the process of this invention to prevent the coalescence of the lubricant droplets, any suitable colloidal stabilizing agent known in the art of forming polymeric particles by the limited coalescence technique can be employed such as, for example, inorganic materials such as, metal salt or hydroxides or oxides or clays, organic materials such as starches, sulfonated crosslinked organic homopolymers and resinous polymers as described, for example, in U.S. Pat. No. 2,932,629; silica as described in U.S. Pat. No. 4,833,060; copolymers such as copoly(styrene-2-hydroxyethyl methacrylate-methacrylic acid-ethylene glycol dimethacrylate) as described in U.S. Pat. No. 4,965,131, all of which are incorporated herein by reference. Silica is the preferred suspension stabilizing agent for use in accordance with this invention.

In order to provide suitable coating compositions for applying a layer containing the lubricant droplets in accordance with this invention to a photographic element, such as, a protective layer being the outermost layer over the light-sensitive emulsion layers of a photographic element, the dispersion of the lubricant droplets in water is mixed with a suitable hydrophilic colloid in suitable proportions to achieve the coverage of lubricant droplets desired. The coating composition is then applied to the surface of the element to achieve a layer containing the coated lubricant droplets in the hydrophilic colloid. Other additional compounds may be added to the coating composition, including surfactants, emulsifiers, coating aids, matte particles, rheology modifiers, crosslinking agents, inorganic fillers such as conductive and nonconductive metal oxide particles, pigments, magnetic particles, biocide, and the like.

Suitable hydrophilic binders include both naturally occurring substances such as proteins, protein derivatives, cellulose derivatives (e.g. cellulose esters), gelatins and gelatin derivatives, polysaccaharides, casein, and the like, and synthetic water permeable colloids such as poly(vinyl lactams), acrylamide polymers, poly(vinyl alcohol) and its derivatives, hydrolyzed polyvinyl acetates, polymers of alkyl and sulfoalkyl acrylates and methacrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl acrylate and methacrylates, vinyl imidazole copolymers, vinyl sulfide copolymers, homopolymer or copolymers containing styrene sulfonic acid, and the like. Gelatin is preferred.

The hydrophilic colloid of the lubricant layer can cause coalescence of the oil droplets or more specifically aggregation of the droplets. To prevent this destabilization, suitable anionic surfactants have to be included in the mixing step to prepare the coating composition such as polyisopropyl naphthalene-sodium sulfonate. Suitable surfactants used for this purpose are described in U.S. Pat. No. 5,541,048. Such surfactant additions make the process more complicated and limit the utility of the system. We have found that the promoter used in making the oil droplets play a significant role in controlling the subsequent dispersibility of the droplets in gelatin and other hydrophilic colloids. The presence of a water soluble polymer containing heterocyclic aromatic nitrogen groups prevents aggregation of the droplets and facilitates the dispersion of the droplets in hydrophilic colloids, typically gelatin.

U.S. Pat. No. 5,541,048 describes many suitable promoters that can be used to drive the suspension stabilizing agent to the interface of the lubricant droplets. However there is no mention in the prior art of the role of the promoter in aiding subsequent dispersibility in gelatin. The water-soluble polymer of the invention containing heterocyclic aromatic nitrogen groups, while driving the suspension stabilizing agent to the interface of the lubricant droplets also enhances dispersibility of the oil droplets in hydrophilic colloids such as gelatin in the absence of added surfactant. Such promoters also improve the shelf life of the dispersion of oil droplets in water in terms of its colloidal stability. While, water-soluble complex resinous amine condensation products of diethanol amine and adipic acid, such as poly [oxyethylene (N-methylimino)adipoyl], water-soluble condensation products of ethylene oxide, urea and formaldehyde, and polyethyleneimine, are mentioned in U.S. Pat. No. 5,541,048, there is no mention of the heterocyclic aromatic nitrogen-based copolymer. Further, the parent adipate, poly [oxyethylene(N-methylimino)adipoyl], does not enable the limited coalescence process of lubricant droplets and the preferred promoter the '048 patent does not promote their dispersibility in gelatin without the aid of an added surfactant, neither does it enable the limited coalescence process without the presence of an added solvent to the oil phase. The promoters of the present invention overcome these limitations.

The promoters of the invention contain heterocyclic aromatic nitrogen functionalities including single or condensed ring systems such as quinolines, pyridines, imidazoles, carbazoles, pyrroles, indoles, pyrazoles, pyrimidines and purines. The preferred promoters of the invention contain aromatic pyridine functionalities. The heterocyclic aromatic nitrogen derived monomer content of the promoter is preferably from about 0.5 to about 50 mole percent and most preferably from 2.5 to 10 mole percent based upon the total monomer stoichiometry of the polymer. The degree of polymerization is 1 to 25, most preferably 1 to 10. The promoter is present in the lubricant layer in amounts resulting in a dry coverage of from 0.01 to 10 percent of the lubricant. The preferred promoter for use in accordance with the invention is poly[oxyethylene(N-methylimino)adipoyl-co-oxyethylene(N-methylimino)Carbonylpyridine-2,6-diylcarbonyl](90/10).

The protective layer useful in the practice of the invention can be applied in any of a number of well-known techniques, such as dip coating, rod coating, blade coating, air knife coating, gravure coating and reverse roll coating, extrusion coating, slide coating, curtain coating, and the like. The lubricant particles and the binder are preferably mixed together in a liquid medium to form a coating composition. The liquid medium may be a medium such as water or other aqueous solution in which the hydrophilic colloid is dispersed with or without the presence of surfactants.

Photographic elements in which the droplets of the invention can be utilized generally comprise at least one light-sensitive layer, such as silver halide emulsion layer. This layer may be sensitized to a particular spectrum of radiation with, for example, a sensitizing dye, as is known in the art. Additional light-sensitive layers may be sensitized to other portions of the spectrum. The light-sensitive layers may contain or have associated therewith dye-forming compounds or couplers. For example, a red-sensitive emulsion would generally have a cyan coupler associated therewith, a green-sensitive emulsion would be associated with a magenta coupler, and a blue-sensitive emulsion would be associated with a yellow coupler. Other layers and addenda, such as antistatic compositions, subbing layers, surfactants, filter dyes, protective layers, barrier layers, development inhibiting releasing compounds, and the like can be present in photographic elements of the invention, as is well-known in the art. Detailed description of photographic elements and their various layers and addenda can be found in *Research Disclosure* September 1996, Item 38957 and in James, *The Theory of the Photographic Process*, 4th, 1977.

Photographic elements suitable for use in combination with the protective layer containing lubricant droplets in accordance with this invention are disclosed in *Research Disclosure* 38957, September 1996, which is incorporated herein by reference. Further, the light-sensitive elements disclosed in U.S. Pat. No. 4,980,267 fully incorporated herein by reference are particularly applicable to protection by the overcoat layers in accordance with this invention.

The present invention is also directed to a single use camera having incorporated therein a photographic element as described above. Single use cameras are known in the art under various names: film with lens, photosensitive material package unit, box camera and photographic film package. Other names are also used, but regardless of the name, each shares a number of common characteristics. Each is essentially a photographic product (camera) provided with an exposure function and preloaded with a photographic material. The photographic product comprises an inner camera shell loaded with the photographic material, a lens opening and lens, and an outer wrapping(s) of some sort. The photographic materials are exposed in camera, and then the product is sent to the developer who removes the photographic material and develops it. Return of the product to the consumer does not normally occur.

Single use camera and their methods of manufacture and use are described in U.S. Pat. Nos. 4,801,957; 4,901,097; 4,866,459; 4,849,325; 4,751,536; 4,827,298; European Patent Applications 460,400; 533,785; 537,225; all of which are incorporated herein by reference.

The photographic processing steps to which the raw film may be subject may include, but are not limited to the following:

1.) color developing→bleach-fixing→washing/stabilizing;

2.) color developing→bleaching→fixing→washing/stabilizing;

3.) color developing→bleaching→bleach-fixing→washing/stabilizing;

4.) color developing→stopping→washing→bleaching→washing →fixing→washing/stabilizing;

5.) color developing→bleach-fixing→fixing→washing/stabilizing;

6.) color developing→bleaching→bleach-fixing→fixing→washing/stabilizing;

Among the processing steps indicated above, the steps 1), 2), 3), and 4) are preferably applied. Additionally, each of the steps indicated can be used with multistage applications as described in Hahm, U.S. Pat. No. 4,719,173, with co-current, counter-current, and contraco arrangements for replenishment and operation of the multistage processor.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 02/09932; U.S. Pat. No. 5,294,956; EP 559,027; U.S. Pat. No. 5,179,404; EP 559,025; U.S. Pat. No. 5,270,762; EP 559,026; U.S. Pat. Nos. 5,313,243; 5,339,131.

The present invention is also directed to photographic systems where the processed element may be re-introduced into the cassette. These systems allow for compact and clean storage of the processed element until such time when it may be removed for additional prints or to interface with display equipment. Storage in the roll is preferred to facilitate location of the desired exposed frame and to minimize contact with the negative. U.S. Pat. No. 5,173,739 discloses a cassette designed to thrust the photographic element from the cassette, eliminating the need to contact the film with mechanical or manual means. Published European Patent Application 0 476 535 A1 describes how the developed film may be stored in such a cassette.

It is, at times, desirable to include in the layer containing the lubricant droplets, in accordance with this invention, an amount of polymeric emulsion polymerized latex particles to improve adhesion during processing. Suitable polymeric latex particles have a diameter of from about 0.01 to 0.5 $\mu$m, preferably from about 0.02 to about 0.1 $\mu$m and are employed in an amount of from about 10 to about 75 weight percent, preferably from about 25 to about 50 percent by weight based on the weight of the gelatin present in the layer. Suitable monomers for use in the preparation of latex homopolymers or copolymers include, for example, methyl acrylate, methyl methacrylate, 2-acrylamido-2-methyl propane sulfonic acid, styrene, butyl methacrylate, 2-methacryloyloxyethyl-1-sulfonic acid-sodium salt, vinylidene chloride, itaconic acid, acrylonitrile, acrylic acid, n-butyl acrylate, 2-[N,N,N-trimethyl ammonium] ethyl methacrylate methosulfate and the like. Particularly, suitable copolymers include polymethyl acrylate-co-2-acrylamido-2-methylpropane sulfonic acid (96:4), styrene-co-butylmethacrylate-co-2-methacryloyloxy-ethyl-1-sulfonic acid-sodium salt, methyl acrylate-co-vinylidene chloride-co-itaconic acid, acrylonitrile-co-vinylidene chloride-co-acrylic acid, n-butyl acrylate-co-methylmethacrylate, acrylonitrile-co-vinylidene chloride-co-2[N,N,N,-bimethyl ammonium] ethyl methacrylate methosulfate and the like.

The following examples are intended to illustrate the present invention but not to limit it in scope in any way. The percentages provided are by weight. The promoters used in the examples are described in Table 1.

TABLE 1

| PROMOTER | DESCRIPTION |
|---|---|
| P1 | Poly[oxyethylene(N-methylimino)adipolyl] |
| P2 | Triethylphenyl ammonium hydroxide |
| A | Poly[oxyethylene(N-methylimino)adipolyl-co-oxyethylene(N-methylimino)carbonylpyridine-2,6-diylcarbonyl] (90/10) |
| B | Poly[oxyethylene(N-methylimino)adipolyl-co-oxyethylene(N-methylimino)carbonylpyridine-2,6-diylcarbonyl] (95/5) |
| C | Poly[imino(2-methylpentane)1,5diyliminoadipolyl-co-imino(2-methylpentane)1,5diyliminocarbonylpyridine-2,6-diylcarbonyl] (90/10) |

Triethylphenyl ammonium hydroxide (P2) was obtained commercially. The promoter variants P1, A, B, and C were all prepared by means of melt phase polycondensation techniques without the use of catalyst. These techniques are familiar to those skilled in the art and are documented in Sorensen and Campbell "Preparative methods of polymer chemistry", pp. 57–148, Interscience Publishers, Inc., New York (1961). The extent of reaction and therefore the degree of polymerization were controlled by monitoring the amount of distillate produced. This technique allows for control of both the degree of polymerization and the composition.

Control Promoter P1, poly [oxyethylene(N-methylimino) adipoyl]: 75.11 grams (1.0 moles) of N-methylaminoethanol were added to a 500 ml, three neck round bottom flask equipped with a stirrer, water-cooled condenser, Argon inlet, thermometer, and a Dean-Stark trap. The contents were heated to 80° C., and 146 grams (1.0 moles) of adipic acid were added with stirring to obtain a white dispersion. The resulting dispersion was then heated to 150° C. which resulted in a clear melt and the evolution of distillate. The reaction was continued until 20.0 milliliters of water was collected. The viscous melt was then poured into a collection vessel and cooled to room temperature. The product obtained was a viscous, pale yellow oil at room temperature. Size exclusion chromatography employing a small pore column set showed a polystyrene equivalent molecular weight of 450.

Promoter A; poly [oxyethylene(N-methylimino)adipoyl-co-oxyethylene (N-methylimino)carbonylpyridine-2,6-dicarbonyl](90/10). Promoter variant A was prepared in the same fashion as Control Promoter P1 except the 14.6 grams of adipic acid were replaced with 19.52 grams (0.10 moles) of pyridine 2,6-dimethyldicarboxylate and 4.0 grams (0.22 moles) of water. The resulting pale amber, viscous oil at room temperature had a polystyrene equivalent molecular weight of 465.

Promoter B; poly [oxyethylene(N-methylimino)adipoyl-co-oxyethylene (N-methylimino)carbonylpyridine-2,6-diylcarbonyl](95/5); Promoter B was prepared in the same fashion as Control Promoter P1 except that 7.3 grams (0.05 moles) of adipic acid were replaced with 9.76 grams (0.05 moles) pyridine 2,6-dimethyldicarboxylate and 2.15 grams (0.12 moles) of water. The resulting pale amber, viscous oil at room temperature had a polystyrene equivalent molecular weight of 435.

Promoter C; poly [imino(2-methylpentane)1,5diyliminoadipoyl-co-imino(2-methylpentane)1,5diyliminocarbonylpyridine-2,6-diylcarbonyl](90/10): Promoter C was prepared in the same fashion as Control Promoter P1 except that all of the N-methylaminoethanol was replaced with 116 grams of 2-methylpentamethylenediamine and 14.6 grams of adipic acid were replaced with 19.5 grams (0.10 moles) of pyridine 2,6-dimethyldicarboxylate and 20 grams (0.22 moles) of water. The resulting promoter polymer had a polystyrene equivalent molecular weight of 560.

EXAMPLES 1–4

An oil phase was prepared consisting of 40 g Dow Corning Silicone Oil DC200 and 4.44 g 2-(2-butoxyethoxyethyl acetate). A 25% suspension of colloidal silica in water was made from 2.22 g of Ludox TM (Dupont, 50% solids) and 2.22 g water. This was added to 97.6 g of distilled water with stirring, followed by 0.72 g of a 5% solution of the promoter. The pH of the dispersion was adjusted to 4 using 1N hydrochloric acid and mixed with the oil phase using a Silverson mixer and then homogenized using a Microfluidizer (Microfluidics) operating at 5000 psi. The resulting disperions were sized using a Coulter Multisizer I. The particle size distribution (PSD) is described by the number obtained by dividing the volume weighted size at the 16th percentile by the number weighted size at the 84th percentile. Table 2 shows the particle sizes and size distributions obtained with the control promoter P1 and the promoters of this invention A, B and C. From the size distributions it is apparent that the introduction of pyridine groups does improve the particle size distribution significantly over the control and yields a smaller particle size for the same amount of promoter, suggestive of better control of the limited coalescence process.

TABLE 2

| Examples | Promoter | Mean Particle Size (volume) in micrometers | PSD |
|---|---|---|---|
| 1 | P1 | 14.7 | 5.78 |
| 2 | A | 8.3 | 2.79 |
| 3 | B | 9.1 | 1.84 |
| 4 | C | 10.3 | 2.80 |

EXAMPLES 5–6

Two dispersions of DC 200 were prepared as described in Example 1–4, except that promoter P2 was used as the control in Example 5 and promoter A in Example 6. The particle size and size distributions of the dispersions were measured as in Examples 1–4 right after making the dispersions and then after aging them for a week at room temperature. Table 3 shows how the size distribution actually gets narrower with time in the case of promoter A while with promoter P2 it gets increasingly worse.

TABLE 3

| Examples | Promoter | Mean Particle Size (volume) initial/final (micrometers) | PSD initial | PSD final |
|---|---|---|---|---|
| 5 | P2 | 9.6/9.8 | 2.34 | 3.04 |
| 6 | A | 10.1/8.3 | 2.40 | 1.84 |

EXAMPLES 7–9

Two dispersions of DC 200 were prepared as described in Examples 1–4 except that no 2-(2-butoxyethoxyethyl acetate) was used in the oil phase and the promoter level was increased to 1.8 g. The promoters used were P1, P2 and A. While, P2 did not allow the limited coalescence process to occur and P1 resulted in limited stabilization, promoter A yielded excellent control of particle size and size distribution as measured in Examples 1–4. The volume mean particle size was 9.87 micrometers and the PSD was 1.45.

EXAMPLES 10–11

After homogenization, 0.56 g of each dispersion derived from examples 5 and 2 were added to 14.2 g of a 13.6% acid processed gelatin solution in water. Microscopic analysis showed that Example 10 exhibited poor dispersibility in gelatin while Example 11 gave a well dispersed system. Table 4 shows the particle size and PSD as measured in Examples 1–4. Example 10 had a much larger mean particle size and PSD as compared to Example 5. Examples 11 and 2 on the other hand were similar in particle size and PSD.

TABLE 4

| Examples | Dispersion | Mean Particle Size (volume) in micrometers | PSD |
|---|---|---|---|
| 10 | Example 5 | 12.4 | 5.79 |
| 11 | Example 2 | 8.3 | 1.82 |

The invention has been described in detail with particular reference to certain preferred embodiments thereof, but it will be understood that variations and modifications can be effected within the spirit and scope of the invention.

What is claimed is:

1. An imaging element comprising;

a support;

at least one imaging layer superposed on the support; and a protective topcoat superposed farthest from the support comprising a binder and lubricant droplets comprising a lubricant and a water soluble polymer containing heterocyclic aromatic nitrogen groups wherein the droplets are surrounded by a particulate stabilizer.

2. The imaging element of claim 1 wherein the heterocyclic aromatic nitrogen groups comprise quinolines, pyridines, imidazoles, carbazoles, pyrroles, indoles, pyrazoles, pyrimidines or purines.

3. The imaging element of claim 1 wherein the lubricant comprises silicone based materials, higher fatty acids, higher alcohols, metal salts of higher fatty acids, higher fatty acid esters, higher fatty acid amides, polyhydric alcohol esters of higher fatty acids, liquid paraffin, fluoro-containing materials, poly(meth)acrylates or poly(meth)acrylamides.

4. The imaging element of claim 1 wherein the protective topcoat further comprises surfactants, polymer latex particles, emulsifiers, coating aids, matte particles, rheology modifiers, crosslinking agents, inorganic fillers, pigments, magnetic particles or biocides.

5. The imaging element of claim 1 wherein the binders comprises proteins, protein derivatives, cellulose derivatives, polysaccaharides, synthetic water permeable colloids, acrylamide polymers, poly(vinyl alcohol), hydrolyzed polyvinyl acetates, polymers of alkyl acrylates, polymers of sulfoalkyl acrylates, polymers of alkyl methacrylates, polymers of sulfoalkyl methacrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl acrylate and methacrylates, vinyl imidazole copolymers, vinyl sulfide copolymers or polymers containing styrene sulfonic acid.

6. An imaging element comprising;

a support;

at least one imaging layer superposed on the support; and a protective topcoat superposed farthest from the support comprising a binder and lubricant droplets comprising a lubricant and a water soluble polymer containing pyridine groups wherein the droplets are surrounded by a particulate stabilizer.

7. The imaging element of claim 6 wherein the lubricant comprises silicone based materials, higher fatty acids, higher alcohols, metal salts of higher fatty acids, higher fatty acid esters, higher fatty acid amides, polyhydric alcohol esters of higher fatty acids, liquid paraffin, fluoro-containing materials, poly(meth)acrylates or poly(meth)acrylamides.

8. The imaging element of claim 6 wherein the protective topcoat further comprises surfactants, polymer latex particles, emulsifiers, coating aids, matte particles, rheology modifiers, crosslinking agents, inorganic fillers, pigments, magnetic particles or biocides.

9. The imaging element of claim 6 wherein the binders comprises proteins, protein derivatives, cellulose derivatives, polysaccaharides, synthetic water permeable colloids, acrylamide polymers, poly(vinyl alcohol), hydrolyzed polyvinyl acetates, polymers of alkyl acrylates, polymers of sulfoalkyl acrylates, polymers of alkyl methacrylates, polymers of sulfoalkyl methacrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl acrylate and methacrylates, vinyl imidazole copolymers, vinyl sulfide copolymers or polymers containing styrene sulfonic acid.

10. The imaging element of claim 6 wherein the water soluble polymer comprises poly [[N-methylaminoethylene adipate ethanol-co-adipic acid-co-pyridine 2,6-dicarboxylate]] [oxyethylene(N-methylimino)adipoyl-co-oxyethylene(N-methylimino)carbonylpyridine-2,6-diylcarbonyl].

11. The imaging element of claim 6 wherein the water soluble polymer comprises a pyridine moiety content of from about 0.5 to 50 mole percent.

12. The imaging element of claim 6 wherein the water soluble polymer comprises a dry coverage of from 0.01 to 10 percent of the lubricant.

13. The imaging element of claim 6 wherein the imaging layer comprises a light sensitive silver halide emulsion layer.

14. The imaging element of claim 5 wherein said proteins are gelatins.

15. The imaging element of claim 9 wherein said proteins are gelatins.

* * * * *